US011737533B1

(12) United States Patent
Jones

(10) Patent No.: US 11,737,533 B1
(45) Date of Patent: Aug. 29, 2023

(54) HARD-SHELL BACKPACK WITH WHEELS

(71) Applicant: John Jones, Richmond, VA (US)

(72) Inventor: John Jones, Richmond, VA (US)

( * ) Notice: Subject to any disclaimer, the term of this patent is extended or adjusted under 35 U.S.C. 154(b) by 0 days.

(21) Appl. No.: 17/574,281

(22) Filed: Jan. 12, 2022

(51) Int. Cl.

| | |
|---|---|
| ***A45C 5/14*** | (2006.01) |
| ***A45F 3/04*** | (2006.01) |
| ***A45C 13/26*** | (2006.01) |
| ***A45C 13/02*** | (2006.01) |

(52) U.S. Cl.
CPC ..... *A45C 5/14* (2013.01); *A45C 13/02* (2013.01); *A45C 13/262* (2013.01); *A45F 3/04* (2013.01); *A45C 2005/147* (2013.01)

(58) Field of Classification Search
CPC ..... A45C 5/14; A45C 13/02; A45C 13/262; A45C 2005/147; A45F 3/04
See application file for complete search history.

(56) References Cited

U.S. PATENT DOCUMENTS 2,742,973 A * 4/1956 Johannesen ..... A61G 5/065 180/65.6
3,497,227 A * 2/1970 Porcello ..... B62B 9/06 280/5.26
4,264,082 A * 4/1981 Fouchey, Jr. ..... B62B 5/026 188/31
4,645,222 A * 2/1987 Hester ..... A61G 5/061 180/8.2
5,447,261 A * 9/1995 Mitomi ..... A45C 5/14 190/18 R
5,634,576 A 6/1997 Arbel
5,676,286 A * 10/1997 Song ..... A45F 3/04 224/153
5,749,503 A * 5/1998 Wulf ..... A45C 7/0086 224/652
5,971,091 A * 10/1999 Kamen ..... A61G 5/04 700/71
5,984,154 A * 11/1999 Scicluna ..... A45F 3/04 224/644
6,179,186 B1 1/2001 Blanking
6,460,866 B1 * 10/2002 Altschul ..... A45F 4/02 280/304.5

(Continued)

FOREIGN PATENT DOCUMENTS

KR 101255673 B1 * 10/2011

OTHER PUBLICATIONS

Osprey: https://www.amazon.com/Osprey-Farpoint-Travel-Backpack-Volcanic/dp/B014EBM6XE?th=1 (Year: 2015).*

*Primary Examiner* — Jennifer Robertson
*Assistant Examiner* — Justin Caudill
(74) *Attorney, Agent, or Firm* — SANCHELIMA & ASSOCIATES, P.A.; Christian Sanchelima; Jesus Sanchelima

(57) ABSTRACT

A two-piece hinged hard shell plastic frame includes a set of shoulder straps. Additionally, the backpack includes a pair of triangle shaped wheels for climbing stairs and a retractable pull handle. A concave back plate structure is positioned on the rear of the backpack for conforming to a person's back. A concave head rest portion is also included on the top end of the backpack which provides a comfortable resting area for a user's head. Furthermore, multiple mesh net style pockets on the exterior of the case for holding various items is provided.

5 Claims, 4 Drawing Sheets

(56) References Cited

U.S. PATENT DOCUMENTS

| | | | | |
|---|---|---|---|---|
| 6,644,675 | B2 * | 11/2003 | Ellis | A61G 5/08 280/47.25 |
| 7,669,862 | B2 * | 3/2010 | Kamara | A45C 5/14 180/8.1 |
| 8,453,896 | B1 * | 6/2013 | Mansell | A45F 3/04 223/89 |
| 8,641,059 | B2 * | 2/2014 | Khodor | B62B 1/12 280/47.28 |
| 8,820,596 | B1 * | 9/2014 | Bergquist | A45F 4/02 224/575 |
| D819,919 | S * | 6/2018 | Mitchell | D34/27 |
| 10,172,429 | B1 * | 1/2019 | Smith | A45C 13/10 |
| 10,561,225 | B2 * | 2/2020 | Parekh | A45F 3/047 |
| D890,516 | S * | 7/2020 | Jacobsen | D3/217 |
| 10,820,673 | B1 * | 11/2020 | Blauer | A45C 5/03 |
| 2002/0145018 | A1 * | 10/2002 | Godshaw | A45F 3/04 224/580 |
| 2004/0195791 | A1 * | 10/2004 | Brookes-Inglis | A45C 5/14 280/47.26 |
| 2009/0249700 | A1 * | 10/2009 | Peterson | E04H 15/06 5/413 AM |
| 2010/0032911 | A1 * | 2/2010 | Sarokhan | B62B 5/026 280/5.28 |
| 2011/0162931 | A1 * | 7/2011 | Collins | A45C 7/0063 190/103 |
| 2013/0192907 | A1 * | 8/2013 | Sarokham | B62B 5/026 180/21 |
| 2016/0286926 | A1 * | 10/2016 | Blumenfeld | A45C 3/04 |
| 2018/0215198 | A1 * | 8/2018 | Winfield | A45F 4/00 |
| 2019/0191855 | A1 * | 6/2019 | Hong | A45F 3/12 |
| 2019/0223579 | A1 * | 7/2019 | Postolek | A45C 5/06 |
| 2020/0337445 | A1 * | 10/2020 | Chang | A45F 3/10 |

* cited by examiner

HARD-SHELL BACKPACK WITH WHEELS

BACKGROUND OF THE INVENTION

1. Field of the Invention

The present invention relates to a backpack system and, more particularly, to a hard-shell backpack system with wheels that includes triangle shaped wheels for traversing stairs and a concave shaped backrest for conforming to a user's back.

2. Description of the Related Art

Several designs for a backpack have been designed in the past. None of them, however, include a backpack including a two-piece hinged hard shell plastic 15 frame with a set of shoulder straps. Additionally, the backpack includes a pair of triangle shaped wheels for climbing stairs and a retractable pull handle. A concave back plate structure is positioned on the rear of the backpack for conforming to a person's back. A concave head rest portion is also included on the top end of the backpack which provides a comfortable resting area for a user's head. Furthermore, multiple mesh net style pockets on the exterior of the case for holding various items is provided. It is known that individuals such as school children often carry backpacks which contain heavy study material which cause harmful strain on the child's back. Therefore, there is a need for a hard-shell backpack system that includes triangle shaped wheels and a concave shaped back plate for providing a comfortable resting position for a user. The backpack eliminates the back strain associated with carrying a heavy load in the backpack.

Applicant believes that a related reference corresponds to U.S. Pat. No. 6,179,186 issued for a backpack comprising a hard plastic shell and a concave back plate which fits a person's back. Applicant believes that another related reference corresponds to U.S. Pat. No. 5,634,576 issued for a backpack with wheels and a pull handle. However, the cited references differ from the present invention because they fail to disclose a hard-shell backpack with triangle shaped wheels and a concave back portion.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a hard-shell backpack system with wheels that provides a convenient and comfortable backpack for students and travelers.

It is another object of this invention to provide a hard-shell backpack system with wheels that offers a hands-free way to transport books and personal belongings.

It is still another object of the present invention to provide a hard-shell backpack system with wheels that reduces stress and strain on the back and the shoulders of a user.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
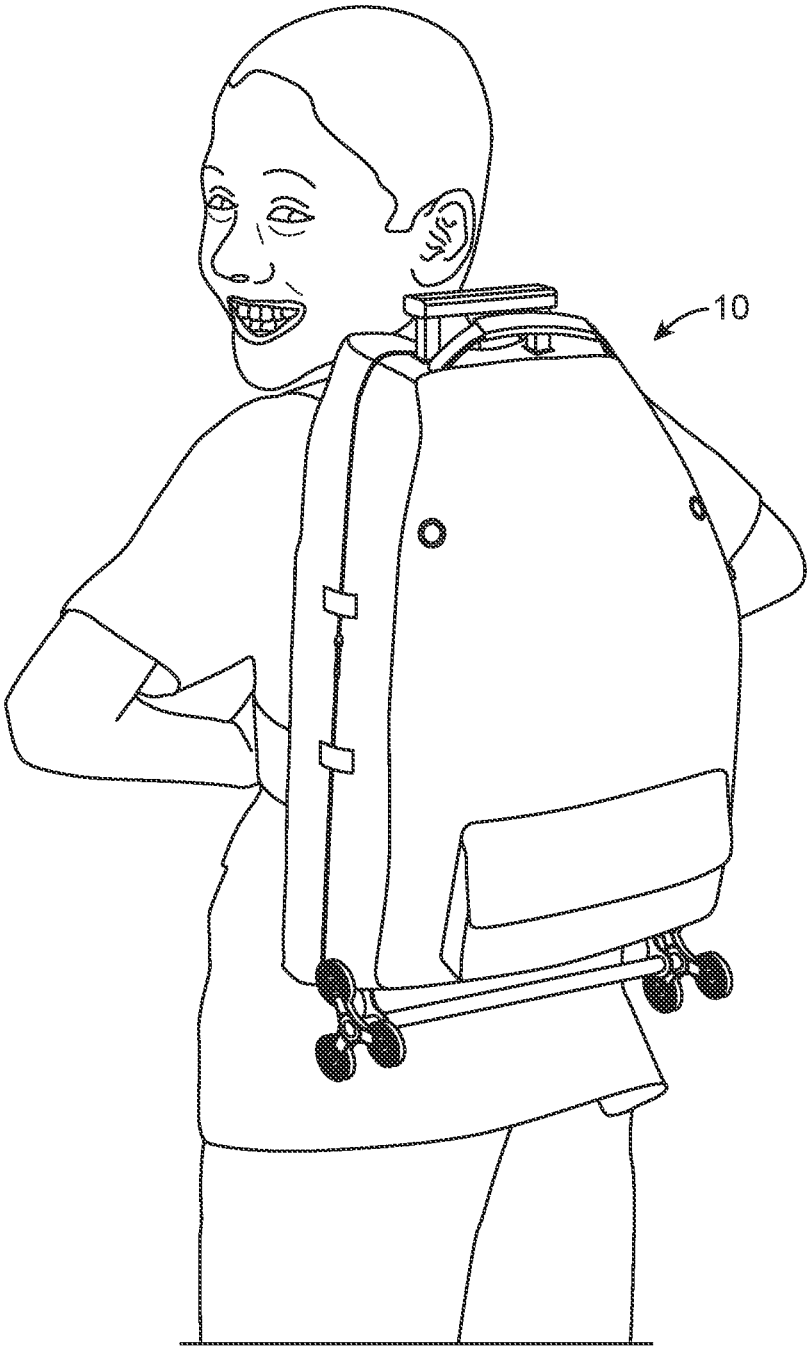
FIG. 1 represents an operational isometric view of the hard-shell backpack system 10 in accordance with an embodiment of the present invention.

Referring now to the drawings, where the present invention is generally referred to with numeral 10, it can be observed a hard-shell backpack system 10 which basically includes a body assembly 20 and a backrest assembly 40.

Figure 4:
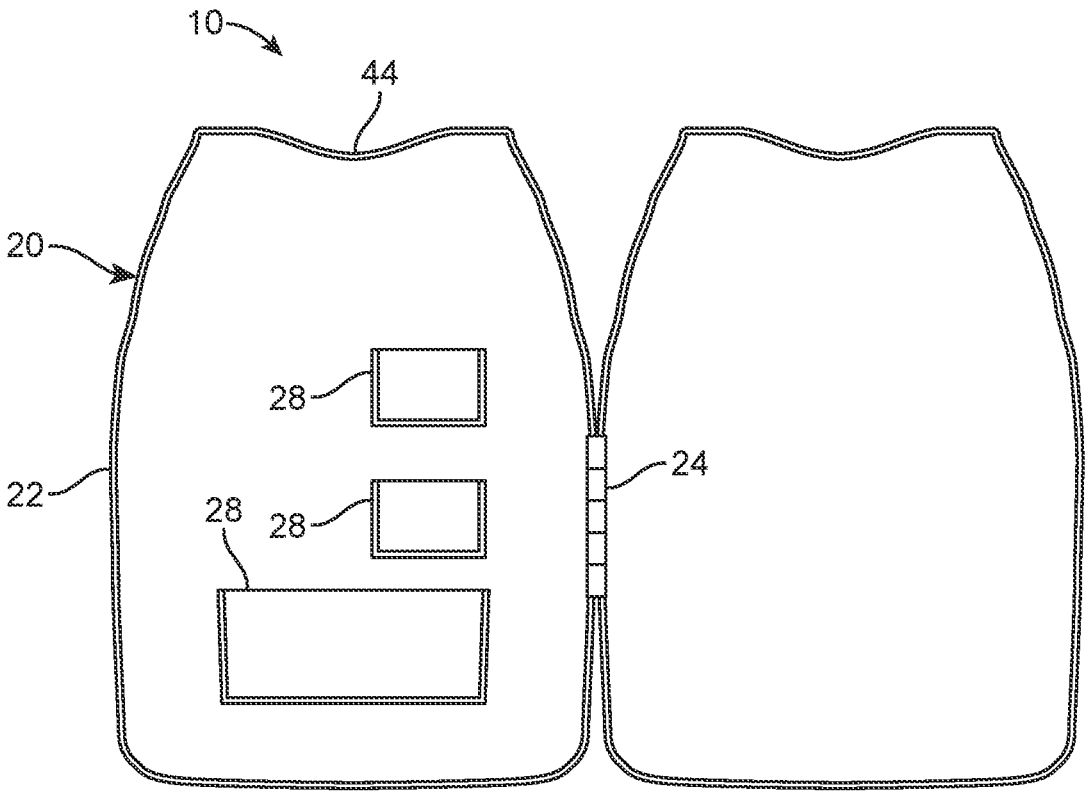
FIG. 4 is a representation of a front view of hard-shell backpack system 10 with body assembly 20 in an open configuration in accordance with an embodiment of the present invention.

Body assembly 20 includes a frame 22 which may represent the frame of a substantially rectangular shaped backpack. In one embodiment, frame 22 is comprised of a two-piece hinged hard shell plastic frame. Other embodiments may feature hard shell frames made from materials other than plastic. As observed in FIG. 4, the two-piece hinged frame members are positioned abuttingly next to each other. Each of the frame members includes four perimeter sides comprised of a top end, a bottom end, and two lateral sides. In the present embodiment, a hinge 24 abuttingly engages the two-piece frame at one of the two lateral sides. The hard shell nature of the two piece frame allows the body assembly 20 to have a continuous defined shape. As a result, the interior of frame 22 remains consistent and allows for a user to place a consistent volume of articles within frame 22. Additionally, the lateral sides of frame 22 further includes latches 23 in order to engage frame 22 in a closed configuration.

Body assembly 20 further includes a top handle 25 located at a top end of frame 22. In one embodiment, top handle 25 is a stationary handle that is made of a cloth material. Top handle 25 aids a user in carrying the backpack by the hand when there is a light load within frame 22. Additionally, frame 22 further includes a retractable pull handle 26 located on the top end of frame 22. Pull handle 26 is a retractable handle member comprising two vertical portions and a horizontal portion that retract outwardly from frame 22. In the present embodiment, pull handle 26 provides a user with an alternative mode to transport frame 22.

Figure 2:
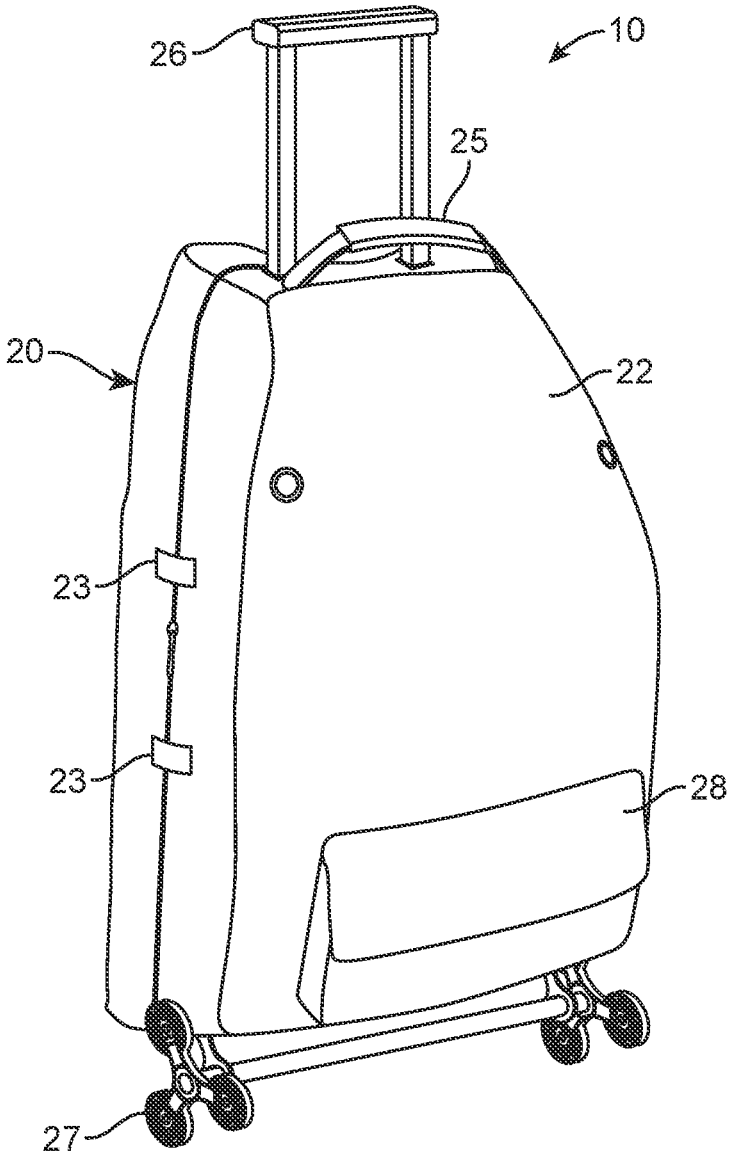
FIG. 2 shows an isometric front view of hard-shell backpack system 10 depicting body assembly 20 in accordance with an embodiment of the present invention.

Body assembly 20 further includes triangle wheels 27 mounted to a bottom end of frame 22. In on embodiment, triangle wheels 27 each comprise of a triangle member that supports three wheels thereon thereby forming triangle wheels 27. In on implementation, frame 22 includes two of triangle wheels 27 operatively connected to each other via a support bar as seen in FIG. 2. Triangle wheels 27 aid a user in carrying frame 22 upwardly and downwardly on a set of stairs. In one embodiment, when a user encounters a set of stairs, they may then engage pull handle 26 and then drag frame 22 against the stairs with triangle wheels 27. The unique structure of triangle wheels 27 will aid the backpack in easily being dragged on the stairs.

Figure 3:
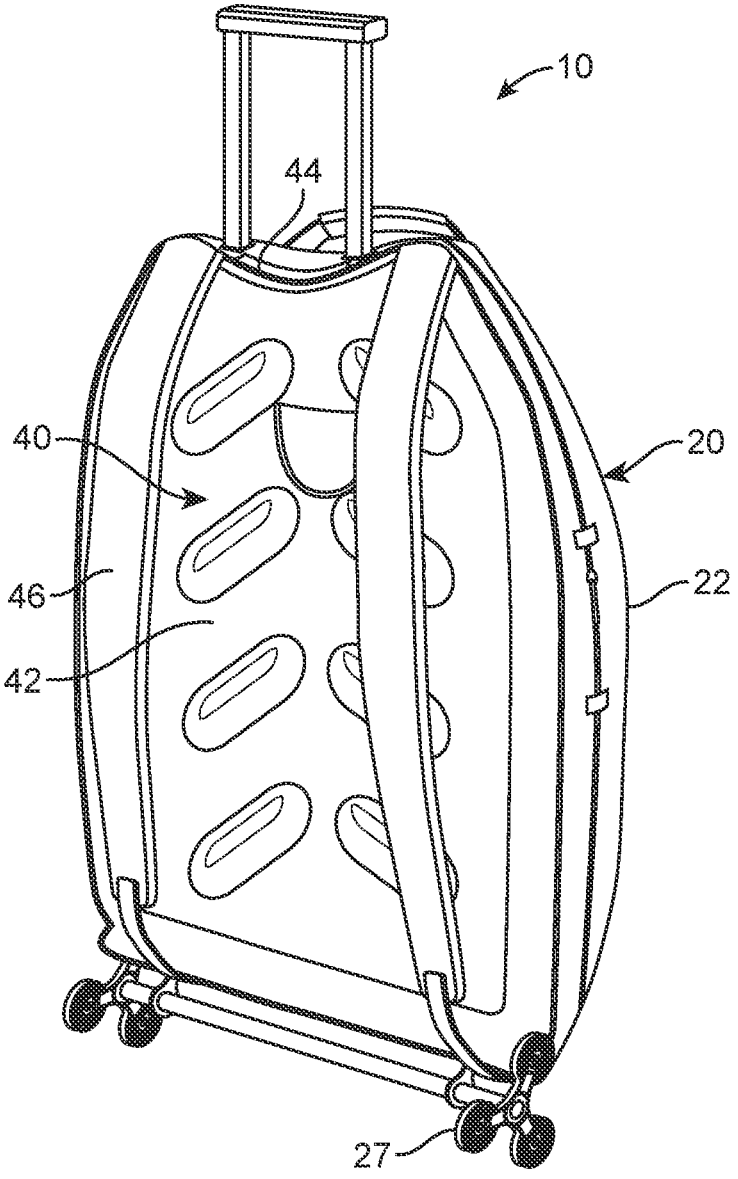
FIG. 3 illustrates an isometric rear view of hard-shell backpack system 10 depicting backrest assembly 40 in accordance with an embodiment of the present invention.

In the present embodiment, body assembly 20 further includes multiple mesh net style pockets 28 positioned along the exterior of frame 22. FIGS. 2 and 3 depict the positioned of mesh pockets 28 along the exterior of frame 22. Mesh pockets 28 support a plurality of articles therein. In one embodiment, as observed in FIG. 4, the interior of frame 22 is also lined with mesh pockets 28 to support articles therein.

Backrest assembly 40 includes a back plate 42 positioned along the rear end of frame 22. In the present embodiment, back plate 42 is a concave back plate structure configured to conform to a user's back. Additionally, back plate 42 further includes a plurality of comfort foam members lined along the outer surface of the back plate as observed in FIG. 3. The present configuration allows for back plate 42 to be comfortably received onto the user's back. Furthermore, back rest assembly 40 includes a head rest section 44. Head rest 44 is provided as a U-shaped cut portion formed along the top edge of back plate 42 and frame 22. When a user positions back plate 42 on their back, head rest 44 provides a comfortable setting for a user to place their head when traveling with frame 22. This proves beneficial to a user's health by preventing neck pain and back pain associated with transporting the backpack for long periods of time.

In the present implementation, back plate assembly 40 further includes a pair of shoulder straps 46. Pair of shoulder straps 46 extend from the top edge of the frame 22 and extend all the way towards a bottom edge of frame 22. As a result, a user may carry the backpack on their back via shoulder straps 46. Furthermore, shoulder straps 46 may be provided as rectangular padded straps.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hard-shell backpack system, comprising:

a) a body assembly including a frame being a two-piece hinged hard shell plastic frame, wherein said frame includes multiple mesh style pockets, a top handle, a top end, a bottom end, and lateral side ends, wherein a single hinge operatively connects said two-piece hinged hard shell plastic frame along one of said lateral side ends, wherein said bottom end includes a pair of triangle wheels located thereon, wherein said pair of triangle wheels are operatively connected to each other via a support bar, wherein said support bar is attached to said bottom end by means of attaching elements protruding outwardly from the lateral side of the bottom end of the frame, wherein said support bar is separated a predetermined distance from said frame, wherein said top end includes a retractable pull handle extending upwardly therefrom, a plurality of multiple mesh net pockets positioned along an exterior of said frame adapted to hold multiple articles, wherein said multiple mesh style pockets located within an interior of said frame, wherein said top handle is located at said top end of the frame, said top handle is a cloth handle; and b) a backrest assembly including a back plate, wherein said back plate is a concave back plate structure adapted to conform to a user's back, wherein said back plate further includes a pair of shoulder straps mounted thereon, a head rest and a top handle, said handle is located at said top end of the frame wherein said head rest is a concave cut portion formed along the uppermost end of said frame.

2. The hard-shell backpack system of claim 1 wherein said pair of triangle wheels each comprise a triangle support structure with a wheel located at each vertices of the triangle support structure.

3. The hard-shell backpack system of claim 1 wherein said retractable pull handle includes two vertical portions connected by a horizontal portion at a top most end, said retractable pull handle slidably inserted within the frame.

4. The hard-shell backpack system of claim 1 wherein said frame includes latches along said lateral side ends to operatively engage said frame in a closed configuration.

5. A hard-shell backpack system, consisting of:

a) a body assembly including a frame being a two-piece hinged hard shell plastic frame, wherein said frame includes a top end, a bottom end, and lateral side ends, wherein a single hinge operatively connects said two-piece hinged hard shell plastic frame along one of said lateral side ends, wherein said lateral side ends include latches to operatively engage the frame in a closed position, wherein said bottom end includes a pair of triangle wheels located thereon, wherein said pair of triangle wheels are operatively connected to each other via a support bar, wherein said support bar is attached to said bottom end by means of attaching elements protruding outwardly from the lateral side of the bottom end of the frame, wherein said support bar is separated a predetermined distance from said frame, wherein said pair of triangle wheels each comprise a triangle support structure with a wheel located at each vertices of the triangle support structure, wherein said top end includes a retractable pull handle extending upwardly therefrom, wherein said top end also includes a top handle located thereon, wherein said top handle is a cloth handle, a plurality of multiple mesh net pockets positioned along an exterior and interior of said frame adapted to hold multiple articles; and b) backrest assembly including a back plate, wherein said back plate is a concave back plate structure adapted to conform to a user's back, wherein said back plate further includes a pair of shoulder straps mounted thereon, said back plate further including a head rest, said head rest is a concave cut portion formed along the uppermost end of said frame, wherein said back plate is lined with a plurality of comfort foam members, wherein said plurality of comfort foam members are eight foam members aligned in two columns of four foam members each, wherein said four foam members are placed vertically aligned and separated a predetermined distance therebetween along the exterior surface of the backplate wherein each of said plurality of comfort foam members have a rounded rectangle shape.

* * * * *